United States Patent [19]

Hille

[11] 4,060,895

[45] Dec. 6, 1977

[54] NON-SYMMETRICAL BAR WITH REVERSIBLE BODY PORTION

[75] Inventor: Arvin A. Hille, Lake Oswego, Oreg.

[73] Assignee: Omark Industries, Inc., Portland, Oreg.

[21] Appl. No.: 741,550

[22] Filed: Nov. 15, 1976

[51] Int. Cl.[2] ..... B27B 17/04

[52] U.S. Cl. ..... 30/384

[58] Field of Search ..... 30/383, 384, 385, 386, 30/387; 83/824, 825

[56] References Cited

U.S. PATENT DOCUMENTS

| | | | |
|---|---|---|---|
| 2,888,964 | 6/1959 | Mall | 30/384 |
| 3,762,047 | 10/1973 | Scott | 30/385 |
| 3,955,279 | 5/1976 | Pierson | 30/384 |
| 3,987,544 | 10/1976 | Gibson | 30/384 |

*Primary Examiner*—Jimmy C. Peters

*Attorney, Agent, or Firm*—Robert L. Harrington

[57] ABSTRACT

A guide bar for a chain saw having a main body portion that is symmetrical so as to be invertible, i.e., to reverse the top and bottom edges, and including a nose portion having fixed top and bottom positions that is removably attached to the outer end of the main bar portion. Said nose portion is non-symmetrical with the upper quadrant of the nose sharply curved away from the top edge and the lower quadrant gradually curved back to the bottom edge. Whereas the main body portion can be inverted, the life of that portion of the bar is greatly increased.

1 Claim, 3 Drawing Figures

NON-SYMMETRICAL BAR WITH REVERSIBLE BODY PORTION

HISTORY OF INVENTION

This invention relates to a guide bar for a chain saw wherein saw chain is entrained on the guide bar for cutting trees and the like. More specifically, this invention relates to a guide bar having a non-symmetrical nose portion.

This invention is an improvement to the invention disclosed and claimed in the commonly assigned U.S. Pat. No. 3,323,561 issued to E. W. Lahtinen. The non-symmetrical bar disclosed in the Lahtinen patent is considered to have greatly imroved the performance of a guide bar, particularly in its ability to guide the saw chain around the nose of the bar in a manner that reduces the undersirable kick back common to conventional guide bars. However, a disadvangtage of the Lahtinen bar is that it cannot be inverted so as to reverse the top and bottom edges. Because the bottom edge of the bar is where most cutting takes place, it wears much faster than the top edge. Accordingly, when the bottom edge wears, the conventional symmetrical bar is inverted to expose the relatively unused prior top edge to the cutting forces and thereby increase bar life.

The present invention overcomes the disadvantage described by providing a symmetrical main body portion that is detachable from the nonsymmetrical nose portion. Thus only a small portion of the bar is noninvertible. The main bar portion represents the greatest expense to the purchaser and can be separated from the nose portion, inverted, reattached to the nose portion, and replaced on the chain saw quite similar to prior conventional methods. Thus the present invention is directed to the concept of providing invertibility to the major portion of the bar and still retain the benefits of the non-symmetrical, non-invertible nose.

The invention will be more clearly understood by reference to the following detailed description and drawings wherein.

Figure 1:
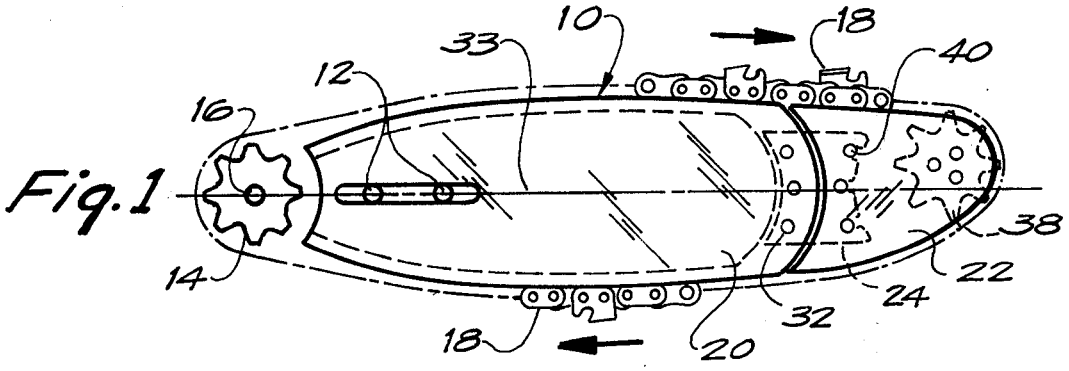
FIG. 1 is a side view of a guide bar in accordance with the present invention illustrating a main body portion attached to a nonsymmetrical nose portion.

Referring to the drawings, a guide bar 10 is adapted to be fastened by bolts 12 to a chain saw housing (not shown). A drive sprocket 14 is driven by the drive shaft 16 of the chain saw to drive a saw chain 18 around the guide bar 10.

Figure 2:
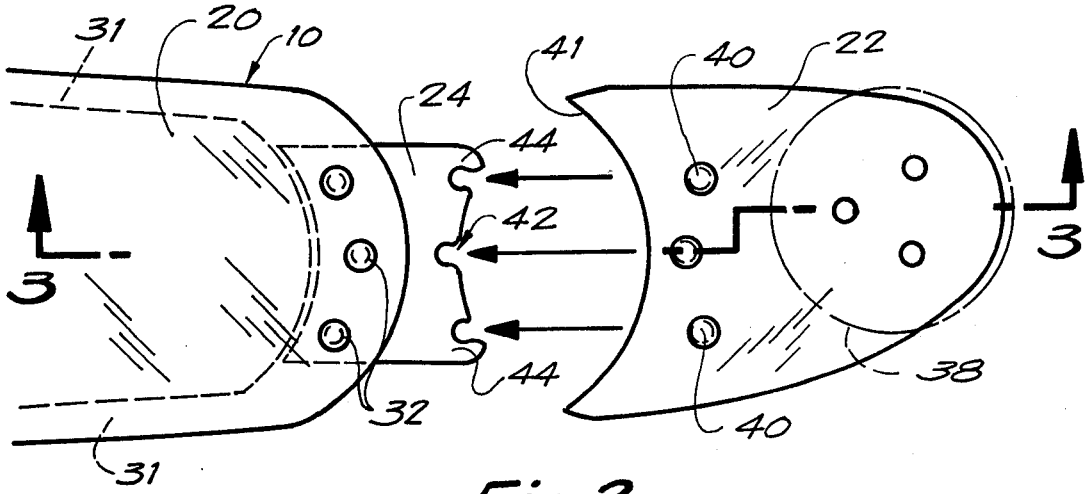
FIG. 2 illustrates the guide bar of FIG. 1 but showing the nose portion separated from the main bar portion to disclose the attaching means.
Figure 3:
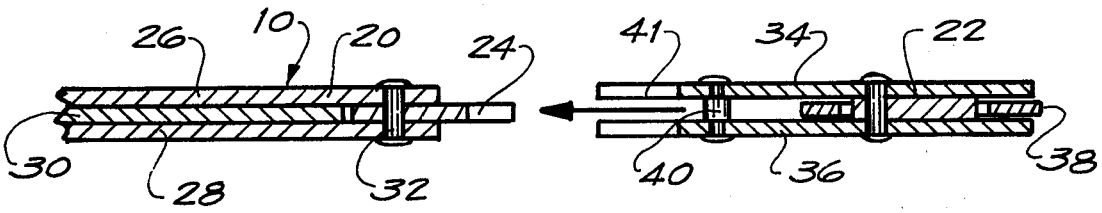
FIG.3 is a section view taken on lines 3—3 of FIG. 2.

The guide bar 10 is comprised of a main bar portion 20 fastened to a nose portion 22 by a web segment 24. The main bar portion is comprised of side plates 26, 28 separated by a center plate 30. As seen in FIG. 2, the center plate is spaced inwardly from the edges of the side plates to provide a groove 31 in the top and bottom edges in which is entrained the drive tangs of the saw chain, and a receiving slot in the outer end for receiving the web segment 24. The web segment 24 is riveted by three symmetrically positioned rivets 32 to the side plates 26, 28. The portion of the web segment extended outwardly of the convexly curved end of the main bar portion is provided with symmetrically positioned receiving slots 42 so that the assembly of the main bar portion 20 and web segment 24 is symmetrical about the center line 33 shown in FIG. 1.

The nose portion 22 is comprised of side plates 34, 36 held in spaced relation by the inner race of a nose sprocket 38 and posts 40. The posts 40 are adapted to be removably inserted in the slots 42 of the connecting web 24. Ears 44 provide interference such as to grip and hold the posts 40 but are deflectable so as to permit removal. The configuration of the nose portion 22 provides a sharp curve for the path of the saw chain in guiding the saw chain to the outer end of the nose and a gradual curve from the outer end to the lower edge of the bar.

It is to be understood that the invention is not in the configuration of the nose or the manner of releasably attaching a nose portion to a main body portion of a saw bar. These particular features are disclosed and claimed in the commonly assigned U.S. Pat. No. 3,323,561, U.S. Pat. No. 3,955,279, and U.S. Ser. No. 681.897. This invention resides in the concept whereby a nose portion utilizing the Lahtinen non-symmetrical design is detachable from a symmetrical main body portion to achieve anti kick back safety with increased bar life.

There will be numerous variations and modifications apparent to the above described embodiment of the invention by those skilled in the art, and accordingly the invention is intended to encompass the scope of the claim appended hereto.

What is claimed is:

1. A chain saw guide bar comprising: a main body portion and a nose portion, said main body portion including means for attaching said main body portion to a chain saw housing with the rearward end adjacent the drive sprocket of the chain saw for driving a saw chain around the guide bar to be guided along the side edges thereof, and releasable connecting means for connecting the nose portion to the forward end of the main body portion, said main body portion forming the major portion of the guide bar being symmetrical about a center line lengthwise of the main body portion where by the side edges are invertible, said nose portion forming a smaller portion relative to the main body portion and having a curved edge formed around the outer end adapted to connect with the side edges of the main body portion to provide a continuous supporting edge for a saw chain from the rearward end along one of said side edges, around the nose portion and back to said rearward end along the other of said side edges, the portion of said curved edge on the top of the nose portion being sharply curved to reduce kick back and the portion of said curved edge on the bottom of the nose portion being relatively gradually curved, and said connecting means connecting the nose portion to the main body portion whereby the main body portion can be inverted relative to the nose portion.

* * * * *